United States Patent [19]

Sivasanker et al.

[11] Patent Number: 4,950,385

[45] Date of Patent: Aug. 21, 1990

[54] REFORMING PROCESS FOR THE CATALYTIC CONVERSION OF PETROLEUM FRACTIONS TO A MIXTURE OF HYDROCARBONS RICH IN AROMATICS

[75] Inventors: Subramanian Sivasanker; Paul Ratnasamy, both of Maharashtra, India

[73] Assignee: Council of Scientific & Industrial Research, New Delhi, India

[21] Appl. No.: 377,539

[22] Filed: Jul. 10, 1989

[51] Int. Cl.[5] ..... C10G 39/00

[52] U.S. Cl. ..... 208/64; 208/65; 208/62; 208/137

[58] Field of Search ..... 208/135, 137, 139, 63, 208/65, 64, 62

[56] References Cited

U.S. PATENT DOCUMENTS

| | | | |
|---|---|---|---|
| 2,401,649 | 6/1946 | Leffer | 208/64 |
| 3,679,575 | 7/1972 | Bentolacin | 208/65 |
| 3,926,780 | 12/1975 | Ward | 208/111 |
| 4,049,539 | 9/1977 | Yan et al. | 208/65 |
| 4,560,536 | 12/1985 | Tabak | 208/135 X |
| 4,615,793 | 10/1986 | Jossens | 208/135 X |
| 4,645,586 | 2/1987 | Buss | 208/65 |

FOREIGN PATENT DOCUMENTS

| | | |
|---|---|---|
| 0083875 | 7/1973 | European Pat. Off. . |
| 0021475 | 1/1981 | European Pat. Off. . |
| 0024147 | 2/1981 | European Pat. Off. . |
| 0050499 | 4/1982 | European Pat. Off. . |
| 160212 | 7/1987 | India . |

*Primary Examiner*—Glenn Caldarola

*Attorney, Agent, or Firm*—Abelman, Frayne, Rezaz & Schwab

[57] ABSTRACT

The process disclosed is for the improved reforming of petroleum fractions by catalytic conversion to a mixture of hydrocarbons rich in aromatics. In the process, naphtha fraction is contacted with two types of catalysts (1) a conventional reforming catalyst and (2) an acidic reforming catalyst containing a crystalline iron silicate. Splitting the reformate into two fractions and recycling the same to the two different reaction zones containing the two types of catalysts. The fraction recycled to the acidic reforming catalyst is rich in aromatics.

11 Claims, 1 Drawing Sheet

FLOWSHEET OF THE SPLIT-RECYCLE PROCESS

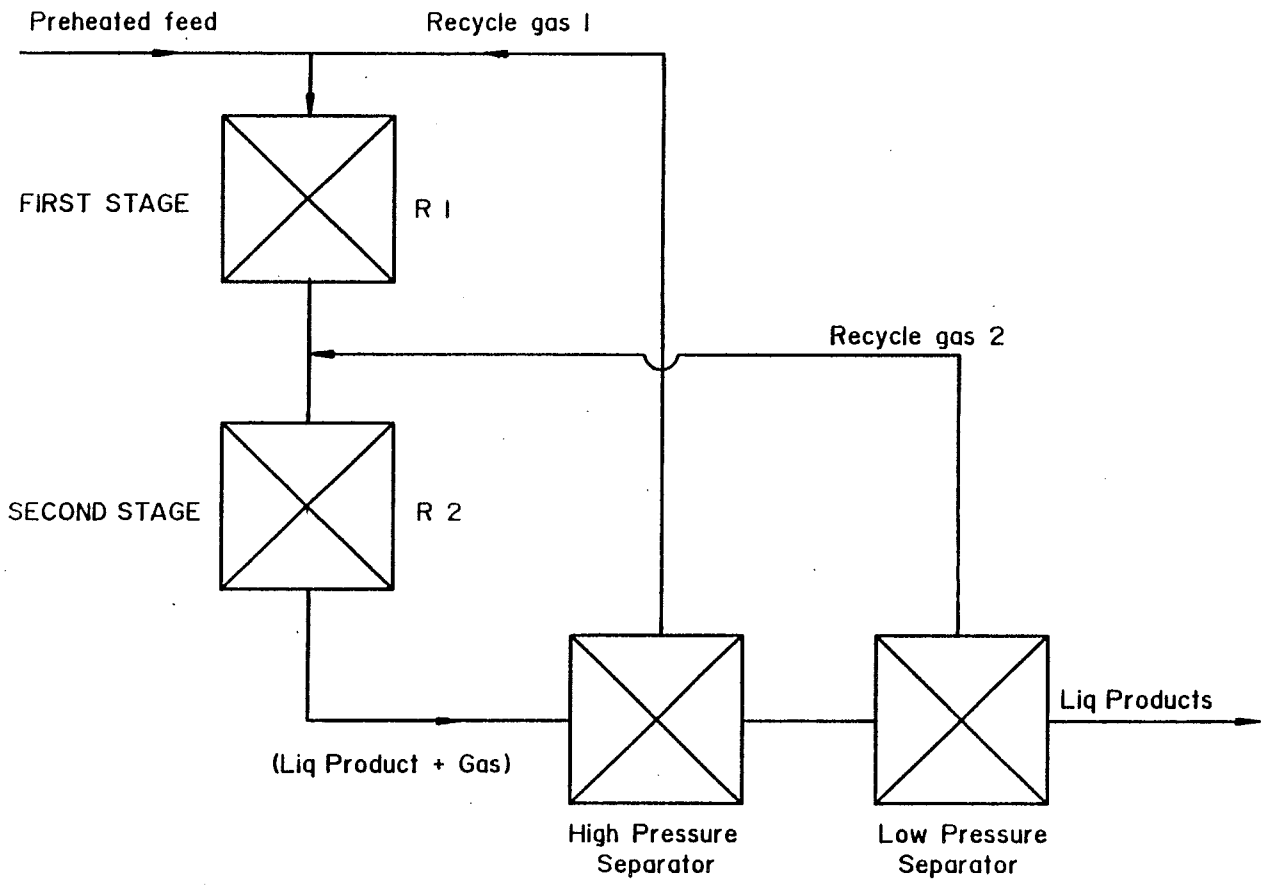
FIG. 1. FLOWSHEET OF THE SPLIT-RECYCLE PROCESS

REFORMING PROCESS FOR THE CATALYTIC CONVERSION OF PETROLEUM FRACTIONS TO A MIXTURE OF HYDROCARBONS RICH IN AROMATICS

The present invention relates to an improved reforming process for the catalytic conversion of petroleum fractions to a mixture of hydrocarbons rich in aromatics. More specifically, it relates to a reforming process wherein the naphtha fraction is contacted with two types of catalysts one of which contains a crystalline iron silicate and recycling two different fractions of the reformate to the two different reaction zones containing the two types of catalysts.

Reforming processes using solid catalysts are in practice in the petroleum industry for the manufacture of high octane motor gasoline and aromatic compounds like benzene, toluene and xylenes. In prior-art, it has been known to contact various hydrocarbon feedstocks, especially the naphtha fractions obtained by the fractional distillation of crude petroleum oil in admixture with hydrogen over bifunctional catalysts containing metallic and acidic functions and, in particular, solid aluminous acidic catalysts containing metals like platinum, for upgrading them into very high octane motor fuel blendstock or to products rich in aromatics suitable for manufacture of pure aromatics, especially, benzene, toluene and xylenes, by extraction techniques. These conversion processes are classified as naphtha reforming. In general, these processes contact petroleum hydrocarbon fractions preferably, the naphtha fraction boiling between 60° to 150° C. with a catalyst composite material consisting of an acidic chlorided alumina, containing about 0.1 to 0.8 wt. % of a metal like platinum along with 0.1 to 0.8 wt. % of one or more promoters like rhenium, iridium, tin and germanium, under suitable reforming conditions of temperature, pressure and space velocity.

The reactions occurring in catalytic naphtha reforming are varied and complex and depend upon the dual catalytic function of both the metal and the acidic support. In one mode of operation, suitable for the manufacture of motor gasoline, the normal alkane components of the feedstock are converted into isoalkanes, cycloalkanes and aromatics. In another mode of operation, especially suited for the manufacture of aromatic hydrocarbons, the isoalkanes and cycloalkanes are also converted into aromatics, typically benzene, toluene and xylene. The conversion of alkanes into aromatics is called dehydrocyclization, and, this by far, is the most difficult to accomplish and the activity of a reforming catalyst is best judged by its ability to convert alkanes into aromatics. The dehydrocylization reactions which convert alkanes into aromatics can take place either on the metal alone as a monofunctional reaction or on both the support acid sites and the metal as a bifunctional reaction.

The prior-art reforming catalysts are broadly classified into two categories viz. monometallic catalysts containing only platinum (the monometallics) and multimetallic catalysts containing platinum and one or more of the promoters. The former catalysts operate well at low severity conditions (like high pressures, low temperatures, and large $H_2$/HC ratios) under which conditions aromatics yields are lower due to thermodynamic constraints. These catalysts can operate at high sulphur contents in the feed material up to 10 ppm. On the other hand, the bi- and multimetallic catalysts operate well (without significant activity loss) at higher severity conditions (like low pressures, high temperatures and low $H_2$/HC ratios) which are conductive to larger aromatic yields. However, the catalysts used in the later processes are easily poisoned by feed sulphur and require feeds with less than 1 ppm sulphur for economical run lengths.

The prior-art reforming processes are broadly classified into semi-regenerative, cyclic and continuous regenerative types. For a given catalyst, the severity level of economic operation increases in the order semi-regenerative<cyclic<continuous regenerative process. Therefore, for the given catalyst, the aromatics production increases in the same abovementioned order. Also, the operating cost of the process and the installation costs also increase in the same order, thus partially off-setting the economic advantage of increased aromatics production. One limitation of the prior-art processes is that the amount of aromatics produced in the process is limited by the nature of the components present in the feedstock. Components in the feedstock or in the recycle gases which contain less than six carbon atoms in the molecule cannot undergo conversion into aromatic.

Another limitation of the prior-art processes is that the number of carbon atoms in the aromatic molecules is limited by the number of carbon atoms in its paraffinic precursor. Alkylation reactions of aromatics by molecules in the naphtha fraction containing less than six carbon atoms do not occur to any significant extent.

Yet another limitation of the prior art processes is their inability to utilize gaseous olefins or olefin precursors, like alcohols, as additional feedstock to enhance the total yield of high octane motor fuel blendstock, and to enhance the aromatic content.

Yet another limitation of the prior art processes using prior art catalysts is that they can neither oligomerize the cracked low molecular weight products present in the recycle gas into useful aromatic compounds nor convert added olefinic gases (obtained from other sources in the refinery like the fluid catalytic cracker) into aromatic products.

Yet another limitation of the prior art processes is that the coke lay down on the prior art catalysts is rapid thereby demanding the use of relatively high partial pressures of hydrogen during the reforming of hydrocarbons, thereby incurring a high expenditure of energy in operating the gas recycle compressors.

Yet another limitation of the prior art processes is their low liquid yield due to the high propensity for hydrocracking of the conventional catalysts used therein.

Yet another limitation of the prior art processes is the necessity to inject a chlorine containing molecule continuously along with the naphtha feedstock to maintain adequate catalyst acidity necessary for the isomerisation reactions thereby necessitating a rigid control of the moisture content of the feedstock.

The process of the present invention provides for the use of a catalyst material wherein it has been found possible to convert molecules containing less than five carbon atoms and feedstock containing naphtha in admixture with olefins and olefin-precursors such as methyl and ethyl alcohols including higher alcohols into high octane motor fuel rich in aromatics. The process also provides for the conversion into aromatics of low molecular weight gases produced during naphtha reforming or added to recycle gas stream.

Various improvements have been made in such processes to improve the performance of reforming catalysts. The possibility of using carriers other than alumina has also been studied. Molecular sieves such as X, L and Y zeolites were studied as catalyst support. U.S. Pat. No. 3,926,780 discloses a method for preparing reforming catalysts containing such zeolites. U.S. Pat. No. 4,615,793 discloses the use of L, X and Y zeolites in a reforming process. U.S. Pat. No. 4,645,586 discloses a reforming process using two reforming catalysts wherein the second reforming catalyst is a non-acidic catalyst comprising a type L zeolite containing platinum. However, catalysts based upon these molecular sieves have not been commercially successful. Variations have been made in the amounts and kinds of catalyst charged to the different reforming reactors of a series to modify or change the nature of the product or to improve $C_5+$ liquid yields. Different catalysts, with differing catalytic metal components have also been used in the different reactors of a series. European Patent Application No. 0083875 disclosed such a process for naphtha reforming wherein the catalyst in the forward most reforming zone contains more platinum while the catalyst in the rearward most reforming zone contains more rhenium in mixture containing both platinum and rhenium.

The possibility of using reforming catalysts containing crystalline silicates other than aluminosilicates have also been studied. European Patent No. EP 21475 discloses the use of a crystalline silicate characterised by a specific x-ray powder diffraction pattern and having following composition:

$$P(0.9+0.3)\ OM_{2/n}0.P(aX_2O_3bY_2O_3)SiO_2$$

wherein

M=H, alkali and/or alkaline earth metal,

X=Rh, Cn and/or Sc

Y=Al, Fe and/or Ga $a>0.5$, $b>0$, $a+b=1<P<0.1$

Similarly, European Patent Nos. EP 24147 and EP 50499 disclose reforming catalysts containing gallium containing aluminosilicates. However, catalysts based upon these non-aluminium containing crystalline silicates have not been commercially successful in naphtha reforming processes, so far.

Improvements in reforming processes have also been proposed. U.S. Pat. No. 4,615,793 discloses a reforming process wherein a hydrocarbon feed is contacted with a reforming catalyst comprising type L zeolite in a reaction vessel to produce a reformate; hydrogen, methane and ethane are stripped from the reformate in a first separator, $C_3$–$C_5$ hydrocarbons are stripped from the stripped reformate in a second separator and then a portion of the hydrogen, methane and ethane and substantially all of the $C_3$–$C_5$ hydrocarbons are recycled to the reaction vessel as heat carrier.

The above variations and modifications have the objective of improving the process with respect to one selected performance objective or another.

It is an object of the present invention to provide a further improved process, particularly, a process capable of enhancing the yield of aromatic hydrocarbons in contrast with prior art processes.

SUMMARY OF THE INVENTION

The present invention overcomes the deficiencies of the prior art by:

1. Using, in combination, a first conventional reforming catalyst comprising an alumina support having disposed therein one or more Group VIII metals and a second acidic reforming catalyst comprising a mixture of alumina and a crystalline iron silicate having dispersed therein platinum, rhenium, iridium, tin, zinc, copper mixtures thereof, as disclosed and claimed in an Indian Patent application No. 160212 (published on 24.6.88), and copending application No. 222/DEL/88. Indian Patent Application No. 160212 discloses a novel crystalline catalyst material having a composition in terms of mole ratio of oxides of formula $$1.0\pm0.2M_2O:\ Fe_2O_3{:}30\text{–}300SiO_2{:}ZH_2O$$

Wherein M is a monovalent cation and Z is 0–20 whereas Indian Patent Application No. 222/DEL/88 discloses a crystalline ferrosilicate having a composition of the formula $$0\text{–}0.4\ Na_2O:\ Fe_2O_3{:}30\text{–}300SiO_2:\ 0\text{–}10H_2O$$

which latter when used in the reforming process of a hydrocarbon feedstock is effected in the presence of catalyst composite material consisting of alumina and one or two noble metals selected from platinum, rhenium, iridium or mixtures thereof.

2. Splitting the recycle hydrocarbon stream into two fractions, passing the first fraction comprising of hydrogen, methane and ethane into the first reaction zone containing the conventional reforming catalyst and passing the second fraction comprising propane and butanes into the second reaction zone containing the second acidic reforming catalyst containing a crystalline iron silicate.

BRIEF DESCRIPTION OF THE DRAWINGS

FIG. 1 illustrates the split recycle flow scheme of the present invention.

DESCRIPTION OF THE PREFERRED EMBODIMENTS

In its broadest aspects, the present invention involves the use of a first catalyst which is a conventional reforming catalyst and a second catalyst which is an oligomerisation catalyst containing a crystalline iron silicate in the reforming of hydrocarbons as described in the above said application Ser. No. 160212 and copending application Ser. No. 222/DEL/88. An advantageous feature of the present invention is that the products of the reforming process, after separation of the $C_5$ plus reformate, are separated into two fractions, a first fraction comprising hydrogen, methane and ethane which is recycled back to the first conventional reforming catalyst zone and a second fraction comprising propane and butanes which is recycled to the second reaction zone. The process of the present invention enables to convert molecules containing less than 5 carbon atoms and feedstock containing naphtha in admixture with such hydrocarbons into high octane motor fuel rich in aromatics. The process also provides for the conversion into aromatics of low molecular weight gases produced during naphtha reforming or added to recycle gas stream.

According to the present invention, the reforming reactions are carried out in two stages. In stage 1, the naphtha fraction is reformed using a mono- or bi-or multimetallic catalyst. The reformate is then contacted with a catalyst composite material containing a crystalline iron silicate in admixture with a Group VIII metal and an inorganic oxide binder. The preparation of the said crystalline iron silicate is more fully described in Indian Patent Application No. 160212 the contents of which are hereby incorporated to show the catalyst composite material useful in the present invention. The recycle gas steam used in the second stage can be additionally mixed with low molecular weight gases from other sources (like fluid catalytic cracker OFF gas) prior to contacting the catalyst composite material hereinbefore mentioned.

According to a feature of the present invention the naphtha feed is mixed with olefinic precursors like alcohols and or olefins and the mixture is passed along with hydrogen over a catalyst material consisting of alumina and, if necessary, one or more metals selected from platinum, iridium, rhenium, silver, gold or tin under dehydrogenating and dehydration conditions. The product from the above reaction is further contacted in the presence of hydrogen with the catalyst composite material containing the crystalline iron silicate.

Another feature of the process of the present invention is that the reactions of stages 1 and 2 mentioned earlier are operated in fixed bed mode. The embodiments of the process are the total pressure of the reaction is in the range 1 atm–30 atm, preferably 5–20 atms more preferably 7–10 atms, the temperatures are in the range 200°–500° and more preferably 450°–530° C., the WHSV's (weight hourly space velocities) are typically in the range 0.1 to 5.0 $hr^{-1}$ more typically in the range 0.5 to 2.00 $hr^{-1}$ and most typically in the range 1.0 to 2.0 $hr^{-1}$.

Yet another feature of the present invention is that the cracked gaseous products and any added olefinic material or precursors (like alcohols) are converted into aromatics through oligomerization reactions, thereby increasing the aromatics yield to levels not attainable by the earlier conventional processes.

An advantageous feature of the present invention is that the catalyst composite material used in the process of the present invention can operate at very high severe conditions, with low deactivation rates and at the same time tolerate sulphur levels as high as 10 ppm. Their operation at high severe conditions leads to larger aromatics yields due to thermodynamic advantages. A novelty of the process of the present invention is that highly olefinic stocks like coke and cracker gasolines can be used as feed materials for the production of aromatics. This was hitherto not economically feasible in conventional processes due to the rapid deactivation, of the catalysts used therein when using olefinic feedstocks.

Another novelty of the processes of the present invention is that the process parameters can be adjusted to yield liquid products which consist almost completely of the aromatic compounds. This is an important advantage if the reformate is to be utilized later for aromatics extraction, as this will not only reduce considerably the load of the extraction unit but will also lead to greater purity of the aromatics produced.

Yet another novel and advantageous feature of the process of the present invention is that the reformate has little or no $C_9$ paraffins which is again desirable in subsequent aromatics extraction processes.

Yet another advantageous feature of the process of the present invention is that the gaseous products consist primarily of $C_3$ and $C_4$ hydrocarbons with very little $C_1$ and $C_2$ hydrocarbons.

In one embodiment of the present invention, the catalyst used in the first reforming zone consists of alumina containing platinum alone or with one or more of the promoters chosen from the group rhenium, iridium, germanium, tin, manganese, lead, gold, palladium, zinc and copper. In the present embodiment of this invention, the catalyst composite material employed in the second reforming zone contains 0.5–20% of the iron silicate zeolite material, 0.1–1% of platinum, and 0–2% wt. of the promoters mentioned hereinabove, the balance being alumina. The catalyst may also contain 0.1–2% wt. of chlorine, incorporated therein during its preparation.

In a preferred embodiment of the process of the present invention, the product of contacting the petroleum naphtha with the said iron silicate containing catalyst is separated into a first light hydrocarbon fraction containing molecules with one to two carbon atoms, of second hydrocarbon fraction containing molecules with 3 to 4 carbon atoms, and a heavy hydrocarbon fraction containing molecules with more than four carbon atoms and recycling the first light hydrocarbon fraction in admixture with hydrogen to the inlet of the first reaction zone containing the conventional reforming catalyst, recycling the second hydrocarbon fraction to the inlet of the second reaction zone containing the second said crystalline iron silicate and processing the heavy hydrocarbon fraction containing molecules with more than four carbon atoms to recover the high octane gasoline containing significant amounts of aromatics.

In naphtha reforming processes, hydrogen is normally used in an amount of hydrogen to hydrocarbon mole ratio of 2 to 10 and preferably from 3 to 6. The hydrogen usually comes from the hydrogen rich gas stream recycled from the exit of the reforming zone after removal of the $C_5$ plus hydrocarbons. This recycle gas stream comprises hydrogen, methane, ethane, propane and butanes and a significant part of it is recycled to the inlet of the reforming zone without any separation or splitting. Modifications to this conventional recycle process are also known. U.S. Pat. No. 4,615,793 discloses a reforming process comprising (1) stripping a first fraction from the reformate in a first separator, (2) stripping a second fraction from said stripped reformate in a second separator, and (3) recycling a portion of said first fraction comprising methane, ethane and hydrogen and substantially all of said second fraction comprising $C_3$–$C_5$ hydrocarbons to the inlet of the reforming zone. The inclusion of $C_5$ hydrocarbons in the recycle stream was claimed to increase the heat capacity per unit of reactant and thereby allow a higher conversion for the same temperature.

In a preferred embodiment of the present invention, there are two recycle gas streams, a first recycle gas stream separated in a first high pressure gas-liquid separator comprising hydrogen, methane and ethane and a second recycle gas stream separated in a second low pressure gas-liquid separator comprising propane and butane. The first recycle gas stream is recycled to the inlet of the first reactor in a multireactor reforming zone and the second recycle gas stream is recycled to the inlet of the last reactor of the said reforming zone. The splitting of the recycle into two fractions and selectively recycling the second fraction comprising propane and butane to the last reactor containing the crystalline iron silicate enables the conversion by oligomerisation over the crystalline iron silicate of the said propane and butane into high octane gasoline containing large quantities of aromatics thereby constituting a substantial improvement over the prior art reforming processes.

In another embodiment of the present invention, the catalyst used in the second stage of the reforming process contains therein a crystalline iron silicate described in Indian Patent Application No. 160212.

The practice of the present invention will be further illustrated with the following examples which are for illustrative purposes only and not to be construed as limitations on the practice of the present invention.

EXAMPLE 1

This example illustrates the preparation of a bimetallic reforming catalyst of the prior-art. A commercially available alumina monohydrate (water content 30%) solid under the trade name CATAPAL B was sieved using a 200 mesh (ASTM) screen 180 g of the 200 mesh material was kneaded with 50 ml of dilute nitric acid containing 3 ml of concentrated $HNO_3$ of Sp. gr. 1.42. Additional water was sprayed on to the mixture while continuously kneading the alumina hydrate into a hard dough. The dough was extruded. The extrudates were dried at room temperature (30° C.) for 6 hrs., then at 110° C. for 10 hrs. and calcined finally at 500° C. for 6 hrs. in a flow of dry air. The weight of the extrudates was 123 g. 1000 ml of a solution of hydrochloric acid in distilled water, containing 1.9 g of chloride ions were taken in a 2 lit. beaker and the calcined extrudates added to it. The mixture was agitated occasionally for 2 hrs. At the end of 2 hours, the solution was decanted out and analyzed for chloride ions. The chloride ions picked up by the extrudates was 1.01 wt. %. The extrudates were next dried at 110° C. for 6 hrs.

b 2 liters of a solution containing 0.99 g. of dihydrogen hexachloroplatinate (IV) hexahydrate equivalent to 0.4 g. of platinum metal and 0.54 of perrhenic acid equivalent to 0.4 g of rhenium metal were taken in a 5 lit. beaker and the chlorinated extrudates added to it. The mixture was kept aside for 24 hrs. with occasional agitation. After 24 hrs., the solution was decanted off and the extrudates dried at 110° C. for 10 hrs. followed by calcination at 550° C. for 6 hrs. The final composition of bimetallic catalyst was 0.33% platinum, 0.32% rhenium, 1.0% chlorine, the rest being alumina. The diameter of the extrudates was 1/16 inch.

EXAMPLE 2

This example illustrates the preparation of the crystalline iron silicate used in the preparation of the reforming catalyst used in the second stage of the reforming process of present invention.

To 20 g of sodium silicate (8.2% $Na_2O$, 27.2% $SiO_2$), 10 ml of water is added to constitute solution A. 3.5 g of triethyl-n-butyl ammonium bromide is dissolved in 10 ml of water to yield solution B. 0.54 g of ferric sulphate in water constitutes solution C. Solutions A, B and C are mixed and 1.75 g of $H_2SO_4$ in water is added to the mixture and the gel formed is heated at 180° C. for one day in an autoclave after which the solid product is filtered, washed with water, dried and finally calcined in air at 500° C. for 8 hours. The chemical composition of the solid crystalline iron silicate zeolite material in the anhydrous form is $Na_2O$: $Fe_2O_3$: 72 $SiO_2$. In the next stage, the sodium ions are replaced by ammonium ions by exchange with ammonium chloride solution. The ammonium ions are then partially replaced by platinum to yield a solid material containing 0.6% wt. of platinum.

EXAMPLE 3

This example describes the preparation of the novel reforming catalyst disclosed in copending Application No. 222/DEL/88 containing the crystalline iron silicate zeolite whose preparation has been illustrated in the preceding example.

166 grams of a commercially available alumina monohydrate of the pseudoboehmite type (Catapal B, supplied by CONOCO, USA) were mixed throughly with 4.3 g of the platinum containing iron silicate zeolite whose preparation has been described in example 2 and kneaded with a dilute solution of nitric acid such that a hard dough containing 3% wt. of nitric acid was obtained. This dough was extruded and the extrudates calcined at 500° C. for 6 hrs. after drying the extrudates at room temperature and at 110° C. The extrudates (1/16" size) were next loaded with 1 wt. % chloride ions by a procedure identical to the one described in Example 1. Subsequently, 120 g of these extrudates were soaked in 2 litres of a chloroplatinic acid solution containing 1.8 g of chloroplatinic acid equivalent to 0.72 g of platinum metal for 24 hours with occasional agitation. The extrudates were then decanted off and dried at 110° C. prior to calcination at 550° C. for 6 hours. The final catalyst contained 0.6% Pt, 4% crystalline iron silicate and 1.0% chlorine, the rest being alumina.

EXAMPLE 4

The reforming of a naphtha (110°–140° C. cut virgin, containing about 1 ppm sulphur) was carried out at 480° C., 18 kg $cm^{-2}$ pressure, WHSV=2 $hr^{-1}$ and $H_2$/HC ratio of 6 with recycle of the gaseous products and $H_2$ in a bench scale reactor with 30 g catalyst samples. The reforming catalyst described in the Example 3 and a prior-art bimetallic catalyst containing platinum, rhenium and chlorine and NOT containing the Fe silicate whose preparation was described in Example 3 were compared. The products were analysed by gas chromatography. Table 1 reports the data.

TABLE 1

| Feed: Neat Ankleshwar Naphtha, 110–114 C cut PNA analysis of feed | | | |
|---|---|---|---|
| Carbon No. | Paraffins | Naphthenes | Aromatics |
| $C_6$ | — | 1.02 | — |
| $C_7$ | 7.14 | 12.89 | 3.78 |
| $C_8$ | 36.00 | 23.65 | 6.54 |
| $C_9$ | 5.94 | 2.66 | 0.38 |

| Product Analysis (cut/wt. %) | | | | |
|---|---|---|---|---|
| | Hours of stream | | | |
| | 52 hours | | 300 hours | |
| Arom. Yield | Present | Prior-art | Present | Prior-art |
| $C_6$ | 2.87 | 1.23 | 2.5 | 1.00 |
| $C_7$ | 23.11 | 15.80 | 19.4 | 15.4 |
| $C_8$ | 37.83 | 34.65 | 32.5 | 32.7 |
| $C_9$ | 3.09 | 3.98 | 2.6 | 3.7 |
| Total | 66.9 | 55.68 | 57.0 | 52.8 |

| Composition of $C_8$ hydrocarbons in the reformate | |
|---|---|
| Wt. % | |
| Hours of stream | |

TABLE 1-continued

| | 52 | | 300 | |
|---|---|---|---|---|
| | Present | Prior-art | Present | Prior-art |
| Paraffins | 0.1 | 23.85 | 0.6 | 29.4 |
| Naphthenes | 0.2 | 0.8 | 0.3 | 1.0 |
| Aromatics | 37.8 | 34.65 | 32.5 | 32.7 |

It is seen from the above table that the process of the present invention utilizing a catalyst containing a ferrisilicate zeolite produces more total aromatics than the prior-art sample both at 52 hours of operation and at 300 hours of operation. The total yields of aromatics are 66.9 and 57.0% at 52 hours and 300 hours for the zeolite containing catalyst used in this invention while the values are only 55.68 and 52.8% for the prior-art catalyst at 52 and 300 hours respectively.

The distribution of the aromatics also reveals that the present process yields more of the economically desirable $C_9$ minus aromatics (BTX) while the yields of the commercially less important $C_9$ plus aromatics are lower.

Again, the composition of the $C_8$ hydrocarbons in the reformate shows that the concentration of paraffins and naphthenes are very low in the product from the present process while they are present in large amounts in the reformate from the prior-art catalyst. This is a major advantage for extraction of $C_8$ aromatics from the reformate.

EXAMPLE 5

This example illustrates the advantages of gas recycle while using the novel catalyst of the present invention. Table 2 compares the performance of the catalyst when it is operated under recycle of hydrogen and other gases obtained from the high pressure product separator and when it is operated in a single pass mode without recycle.

TABLE 2

Feed: Neat Ankleshwar naphtha (S = 1 ppm)
Conditions: T = 480°, P = 18 kg $cm^{-2}$
WHSV = 2 $hr^{-1}$, $H_2$/oil = 6 (mole)
Catalyst: Novel Catalyst of the present invention containing 4 wt. % ferrisilicate zeolite.

| Mode of operation | Product composition, wt. % | | | | | | | | | | Total aromatics wt. % |
|---|---|---|---|---|---|---|---|---|---|---|---|
| | $C_6$ | | | $C_7$ | | | $C_8$ | | | $C_5$+ wt. % | |
| | P | N | A | P | N | A | P | N | A | | |
| Recycle | 1.7 | 0.3 | 2.9 | 0.2 | 0.4 | 23.1 | 0.1 | 0.2 | 37.8 | 85.2 | 66.9 |
| Single pass | 1.8 | 0.1 | 1.4 | 0.2 | 0.2 | 15.4 | 0 | — | 38.0 | 71.6 | 57.8 |

It is noticed that the operation of the novel catalyst of the present invention in recycle mode produces more aromatics (66.9 wt. %) than when it is operated in the single pass mode (57.8 wt. %). Thus it is evident that to obtain maximum benefits out of the process of the present invention, it should be operated with recycle of the product gases including hydrogen. Also, it is noticed that the liquid yield ($C_5$+) increases with recycle (85.2% vs 71.6%). Obviously, during recycle part of the product gases (light hydrocarbons) undergo oligomerization and alkylation reactions over the novel catalyst to yield more aromatics and liquid products.

This example illustrates a method for utilizing the novel catalyst of the present process more advantageously than heretobefore described. FIG. 1 of the drawing accompanying this specification presents a simplified scheme of the process incorporating split recycle. R1 is the first stage reforming reactor containing a conventional prior-art monometallic or bimetallic reforming catalyst. R2 is the second stage reforming reactor containing the novel catalyst of the present invention. The feed enters reactor 1 along with the recycle gas 1 from the high pressure separator. This recycle gas consists primarily of $H_2$ and small amounts of hydrocarbon gases especially $C_1$ and $C_2$. The product of the first reactor and the recycle gas obtained from the low pressure separator (or splitter) are mixed and introduced into the second reactor R2. In the first reactor, the conventional catalyst converts most of the naphthenes and small amounts of paraffins in the feed into aromatics. In the second reactor, the catalyst containing iron silicate converts a large percentage of the remaining paraffins in the product into aromatics by three different routes namely: (1) direct dehydrocyclization of the paraffins, (2) cracking and alkylating the fragments and (3) cracking and oligomerizing the fragments. Thus the product leaving reactor 2 is enriched in aromatics beyond levels that would have been possible by conventional high severity operations. Also, the greater purity of the recycle gas of reactor 1 increases the life of the conventional catalysts. Table 3 compares the results obtained when operating the novel catalyst described in Example 3 as per the scheme in FIG. 1 by combining two bench scale reactors and when operating in a single recycle mode. The catalyst described in example 1 was loaded in R1 while the catalyst of example 3 was loaded in R2. The other conditions of the reaction are temperature =480° C., Press=18 kg $cm^{-2}$, WHSV=2 $hr^{-1}$, $H_2$/oil=mole=6. Feed: Ankleshwar naphtha (S=1 ppm), Catalyst weight: 30 g in each reactor.

TABLE 3

Reforming of naphtha (110–114° C.) by a split-recycle process

| | Aromatic yield at 50 on stream (wt. %) | | | | |
|---|---|---|---|---|---|
| | $C_6$ | $C_7$ | $C_8$ | $C_9$ | Total |
| Single recycle Example 4 | 2.87 | 23.11 | 37.83 | 3.09 | 66.9 |
| Split recycle (present) | 3.05 | 25.23 | 40.76 | 3.61 | 72.65 |
| Conventional bimetallic/ single recycle | 1.23 | 15.80 | 34.65 | 3.98 | 55.68 |

The above results show that a benefit of additional 5 wt. % aromatics can be obtained if the novel catalyst of the present invention is operated by the novel split recycle process described. Thus utilizing both the novel catalyst and the novel process, an aromatic yield enhncement exceeding 15 wt. % has been obtained.

We claim:

1. An improved naphtha reforming process which comprises:

(a) contacting a naphtha feed in admixture with hydrogen in a first reaction zone with a first reforming catalyst at reforming conditions to form a first reformate wherein first reforming catalyst comprises a refractory oxide support containing chlorine and one or more metals, and (b) contacting the said first reformate in a second reactor zone with a second acidic reforming catalyst at reforming conditions to form a second reformate wherein second reforming catalyst includes a crystalline iron silicate containing acidic sites having disposed therein one or more metals, and (c) stripping a first fraction from the said second reformate in a first separator maintained at a high pressure (5 to 30 Kg $cm^{-2}$) and recycling substantially all of the said first fraction to the said first reaction zone, and (d) stripping a second fraction from the second reformate in the second separator maintained at a pressure close to atomospheric and recycling substantially all of the said second fraction to the second reaction zone, and (e) obtaining an aromatics rich liquid reformate from the second separator.

2. A process according to claim 1 wherein said first fraction comprises hydrogen, methane and ethane and said second fraction comprises propane and butane.

3. A process according to claim 1 wherein the pressure in the said first separator is higher than that in the said second separator.

4. A process according to claim 1 wherein the said first reforming catalyst is bifunctional and comprises an alumina support which contains chlorine and has disposed therein platinum, rhenium, iridium, tin or mixtures thereof.

5. A process according to claim 1 wherein the said second acidic reforming catalyst comprises a mixture of alumina and a crystalline iron silicate having disposed therein platinum, rhenium, iridium, tin, zinc, copper or mixtures thereof.

6. A process according to claim 1 wherein the crystalline iron silicate has an apparent pore size from 5 to 6 Angstroms.

7. A process according to claim 5, wherein the content of crystalline iron silicate in the mixture of alumina and crystalline iron silicate is from 0.1 to 20% by weight.

8. A process according to claim 1 wherein the crystalline iron silicate has a composition in the anhydrous state in terms of the mole ratios of oxides as under: $Fe_2O_3$: (30–200)$SiO_2$.

9. A process according to claim 1 wherein reforming conditions are a temperature from 450°–550° C., a pressure from 5–30 bars and a hydrogen to hydrocarbon molar ratio from 2 to 8.

10. A process according to claim 1 wherein the process is effected at a weight hourly space velocity ranging from 0.1 to 5.0 $hrs^{-1}$.

11. A process according to claim 1 wherein the process is effected at a hydrogen to hydrocarbon mole ratio ranging from 2 to 10.

* * * * *